United States Patent [19]

Kniel

[11] 4,012,212

[45] Mar. 15, 1977

[54] PROCESS AND APPARATUS FOR LIQUEFYING NATURAL GAS

[75] Inventor: Ludwig Kniel, Scarsdale, N.Y.

[73] Assignee: The Lummus Company, Bloomfield, N.J.

[22] Filed: July 7, 1975

[21] Appl. No.: 593,222

[52] U.S. Cl. ..... 62/28

[51] Int. Cl.[2] ..... F25J 3/02

[58] Field of Search ..... 62/26, 28, 23, 31

[56] References Cited

UNITED STATES PATENTS

| | | | |
|---|---|---|---|
| 3,257,813 | 6/1966 | Hashemi-tafreshi | 62/26 |
| 3,393,527 | 7/1968 | Swenson et al. | 62/23 |
| 3,616,652 | 11/1971 | Engel | 62/23 |
| 3,735,600 | 5/1973 | Dowdell et al. | 62/26 |

*Primary Examiner*—Jack Sofer
*Attorney, Agent, or Firm*—Marn & Jangarathis

[57] ABSTRACT

There is disclosed a novel process and apparatus for liquefying a hydrocarbon gas under a pressure greater than the critical pressure thereof wherein the gas is first expanded to below the critical pressure thereof to permit the facile separation of $C_5$ and heavier hydrocarbons with the lighter components being re-pressurized to above the critical pressure thereof by such expanding gas prior to the further cooling of such re-compressed lighter components for eventual liquefaction.

13 Claims, 1 Drawing Figure

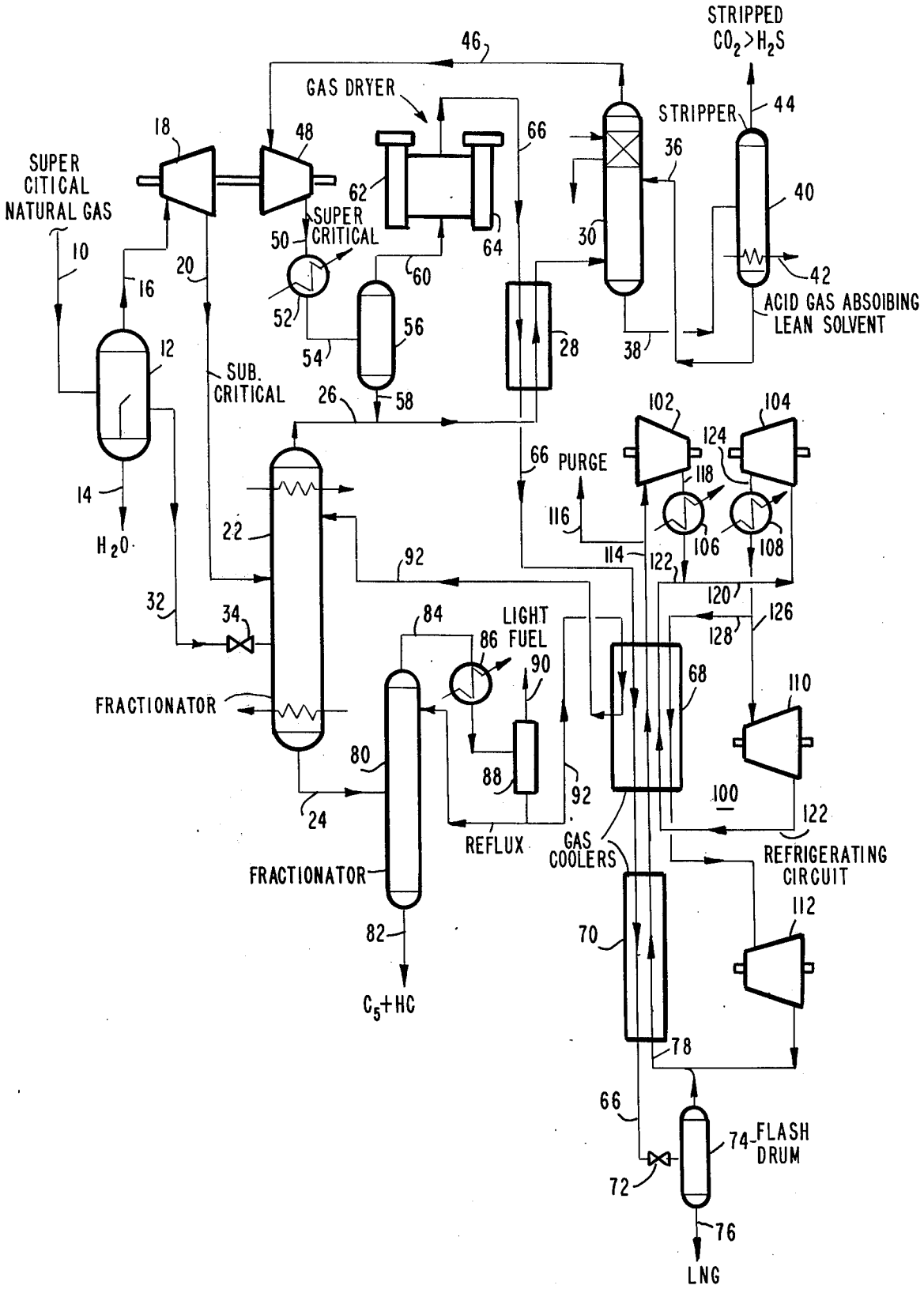
STRIPPED
$CO_2 > H_2S$
46
GAS DRYER
STRIPPER
44
18
48
66
36
SUPER
CITICAL
NATURAL GAS
62
40
SUPER
CRITICAL
50
64
30
10
20
60
42
16
52
56
ACID GAS ABSOIBING
LEAN SOLVENT
12
54
28
38
SUB.
CRITICAL
26
58
102
104
124
66
PURGE
118
14
116
106
108
22
$H_2O$
92
114
122
120
32
34
84
LIGHT
FUEL
126
86
128
90
68
110
FRACTIONATOR
80
88
92
100
24
122
REFLUX
GAS
COOLERS
REFRIGERATING
CIRCUIT
FRACTIONATOR
112
82
70
$C_5$+HC
78
66
74
FLASH
DRUM
72
76
LNG

PROCESS AND APPARATUS FOR LIQUEFYING NATURAL GAS

BACKGROUND OF THE INVENTION

This invention relates to a process and apparatus for the liquefaction of a gas, and more particularly relates to a process and apparatus for the liquefaction of natural gas primarily comprised of methane, and including heavier hydrocarbons such as ethane, propane, butane and the like. Components heavier than the $C_4$ fraction are a major problem in any liquefaction system, since such components freeze at the low temperatures thereby fouling the liquefaction equipment. Additionally, such heavier components may be more valuable as gasoline or other fuels.

There are many reasons for reducing natural gas to a liquefied state. One of the main reasons for liquefying natural gas is the resultant reduction of the volume of the gas to about 1/600 of the volume of natural gas in the gaseous state. Such a reduction in volume permits the storage and transportation of liquefied natural gas in containers of more economical and practical designs. Another important reason is the transportation of liquefied natural gas from a source of plentiful supply to a distant market where the source and supply may not be efficaciously joined by pipe lines, such that the transportation in the gaseous state would be uneconomical.

With the discovery of gas and oil in the Canadian arctic islands to the north of mainland Canada, much thought has been given to devising ways of bringing these commodities, particularly natural gas, to the user markets. While alternate methods to gas pipeline transportation from Prudhoe and the Mackenzie River delta are feasible, the problem of natural gas transportation to the user markets is even more formidable from the fragmented island chain in the Canadian high north, where the initial expense of a pipeline system is substantial for an uncertain capacity and reserve. The erection of a large LNG plant on Ellesmere island, for example, would be most difficult in view of the many imponderables.

Liquefaction systems may be classified according to the method of refrigeration employed to separate the gaseous mixture. There are three common methods of producing the necessary refrigeration, namely (i) vaporization of a liquid refrigerant, (ii) use of the Joule-Thompson effect; and (iii) a Claude cycle, using expanders and compressors. The present invention is a combination of methods (ii) and (iii).

The vaporization method (i) is a simple process wherein the refrigerant fluid is condensed by compression and cooling. The condensed liquid is throttled to a lower pressure whereby a portion flashes and the mixture is thereby cooled to a lower temperature. Liquid coolant is separated from the flash vapor and then flows through a heat exchanger wherein the liquid evaporates substantially at constant pressure as it absorbs heat from the heat exchanger. The vaporized coolant and flash vapors are again compressed and condensed and recycled through the heat exchanger. The most common system utilizing this method is known as a "cascade" system in which two or more coolant fluids are arranged in series so that the one with the lowest boiling point is condensed through the refrigerating effect caused by the evaporation of the one next higher in boiling point, and so on, until the one of highest boiling point is condensed by the atmosphere or by cooling water. One such system used for liquefaction and separation of air into its constituents has utilized three coolant fluids, ammonia, ethylene and methane.

The Claude cycle (iii) utilizes a combined expansion and heat exchange process. Compressed gas is cooled and thereafter expanded, whereby it is further cooled (and may be partially liquefied). The expanded stream is re-circulated through a heat exchanger to provide refrigeration requirements.

OBJECTS OF THE PRESENT INVENTION

An object of the present invention is to provide a novel process and apparatus for separating a normally gaseous hydrocarbon mixture into a light fraction and a heavy fraction.

Another object of the present invention is to provide a novel process and apparatus for liquefying natural gas.

Still another object of the present invention is to provide a novel process and apparatus for liquefying natural gas which may be readily installed in modular form on a vessel.

A still further object of the present invention is to provide a novel process and apparatus for liquefying natural gas which is available at a pressure above the critical pressure thereof.

Another object of the present invention is to provide a novel process and apparatus for liquefying natural gas which is to be installed on a vessel to be positioned in isolated locations.

SUMMARY OF THE INVENTION

These and any other objects of the present invention are achieved by a novel process and apparatus for liquefying a hydrocarbon gas under a pressure greater than the critical pressure thereof wherein the gas is first expanded to below the critical pressure thereof to permit the facile separation of $C_5$ and heavier hydrocarbons (hereinafter referred to as a "$C_5$+ hydrocarbon stream") with the lighter components being re-pressurized to above the critical pressure thereof, preferably by the work from expansion of the gas prior to further cooling of such re-compressed lighter components for eventual liquefaction. It will be readily appreciated that by the process of the present invention the cooling of the lighter components in the dense phase utilizes "cold gas techniques", i.e., a refrigerant in the vapor phase.

The process and apparatus of the present invention is installed in modular form in a vessel in a temperate zone ship yard. Once testing of all auxiliary plants, such as ventilation, desalination, inert gas generation, etc. has been completed at the out-fitting basin of the ship yard, the vessel is towed or proceeds under her own power to an operating LNG plant where each module is tested until functioning satisfactorily. During the summer months, the vessel is brought to its remote destination, such as an arctic location.

DESCRIPTION OF THE DRAWING

A better understanding of the present invention as well as other objects and advantages thereof will become apparent upon consideration of the detailed disclosure thereof, especially when taken with the accompanying drawing illustrating a schematic flow diagram for the liquefaction of natural gas. It is understood, however, that the invention is also applicable to the liquefaction of other gases containing hydrocarbons, such as refinery gases and the like.

DETAILED DESCRIPTION OF THE INVENTION

It is to be understood that equipment, such as passages, valves, indicators, and the like have been omitted from the drawing to facilitate the description thereof and the placing of such equipment at appropriate places is deemed to be within the scope of those skilled in the art.

Natural gas in line 10 at a pressure above the critical pressure thereof, is introduced into a separator 12 wherein any entrained water is separated and passed to disposal by line 14. Natural gas is withdrawn from the separator 12 by line 16 and is introduced into an expander 18 which expands the gas to a pressure below the critical pressure thereof and which may provide recompression energy requirements as hereinafter more fully discussed. Upon expansion, the natural gas is passed by line 20 to a gas fractionator 22 operated under conditions to separate a liquid hydrocarbon stream including substantially all of the $C_5$+ hydrocarbon stream and minor amounts of lighter hydrocarbons which are withdrawn from the fractionator 22 by line 24. The gaseous lighter components including methane, ethane and the like are withdrawn by line 26 and passed via heat exchanger 28 to column 30 for removal of acid gas components, such as carbon dioxide, hydrogen sulfide, if present in the incoming feed stream. Entrained liquid hydrocarbons, if any, separated from the natural gas in separator 12 are withdrawn through line 32, throttled by valve 34 and are introduced into the gas fractionator 22.

Into column 30 there is introduced by line 36 a lean solvent such as MEA, DEA or the like which absorbs the acid gas with the enriched solvent being withdrawn by line 38 and passed to regeneration column 40 including reboiler 42. The stripped acid gas is withdrawn for disposal from column 40 by line 44. The natural gas is then withdrawn by line 46 from absorber column 30 and introduced into a compressor 48 driven by the expander 18 to re-compress the natural gas to a pressure above the critical pressure thereof. The thus re-compressed gas is withdrawn by line 50 and passed in indirect cooled heat transfer relationship with a suitable medium in exchanger 52 and introduced by line 54 into separator 56. In separator 56 any liquid formed during re-compression and passage through exchanger 52 is withdrawn by line 58.

The re-compressed gas is withdrawn by line 60 from separator 56 and passed through dryers 62 and 64 to remove residual amounts of moisture in the dense phase gas. The dryers 62 and 64 are operated in alternate manner as is well known to those skilled in the art.

Dried gas is withdrawn through line 66 and passed through exchanger 28 prior to passage through exchangers 68 and 70 of a refrigeration system wherein the gas is cooled, inter alia, by a refrigerant which is expanded into exchangers 68 and 70, as more clearly hereinafter described. One aspect of my invention is the cooling of natural gas in the dense phase, without liquefaction, whereby at such high pressures a single refrigerant is used with heat being conveniently removed at relatively higher temperatures as sensible heat, which would at lower pressures, show up as latent heat at a lower temperature, such as disclosed in my U.S. Pat. No. 3,413,817, assigned to the same assignee as the present invention.

After passage through the exchangers 68 and 70, the natural gas, still in the dense phase is throttled by valve 72 in line 66 into flash drum 74 operated at a pressure of about 25 psia and at a temperature of about −246° F to liquefy a major portion of the gas. The thus liquefied natural gas is withdrawn from the flash drum 74 and passed by line 76 to storage, preferably in an associated vessel, to be loaded on a vessel including cryogenic tanks, such as disclosed in U.S. Pat. No. 3,877,240, assigned to the same assignee as the present invention. As hereinabove discussed, in the interest of safety only minimal storage capacity of LNG would be provided for on the vessel.

The liquid hydrocarbon stream in line 24 is introduced into refluxed debutanizer column 80 operated under conditions to separate $C_5$+ hydrocarbon streams from lighter components which are withdrawn from column 80 by lines 82 and 84, respectively. The $C_5$+ hydrocarbon stream in line 82 is passed to storage facilities, not shown. The gaseous stream in line 84 is passed through a condenser 86 and introduced into a separator 88 wherein an uncondensed lighter component stream is withdrawn by line 90 to be utilized for fuel values and a condensed heavier component stream is withdrawn by line 92 to provide reflux for the gas fractionator 22 after passage through heat exchanger 68.

The refrigeration requirements of the heat exchangers 68 and 70 are provided by the passage of uncondensed gaseous streams in line 78 withdrawn from flash drum 74, and primarily by a "cold gas process" generally indicated as 100, operated in accordance with the principles of Linde and Claude. Generally, in such a process, a gaseous fluid is passed through a closed cycle alternately being compressed and expanded between heat exchangers which absorb heat from a process stream and dissipate heat to the environment.

The cold gas process 100 includes compressor 102 and 104, heat exchangers 106 and 108, and expanders 110 and 112. The heat transfer medium withdrawn in line 114 after passage through heat exchanger 70 and 68 is passed to first stage compressor 102, with minor draw-off of a purge stream in line 116.

A compressed gas is passed from compressor 102 by line 118 through heat exchanger 106 in indirect heat transfer relationship with a cooling medium and is combined in line 120 with a gas stream from line 122. The gas in line 120 is introduced into second stage compressor 104 wherein the combined heat transfer medium is compressed to the highest operating pressure. A compressed gas is passed from compressor 104 by line 124 through heat exchanger 108 in indirect heat transfer relationship with a cooling medium. The compressed gas in line 124 is divided into two streams 126 and 128. The gas stream in line 126 is introduced into expander 110 and is withdrawn by line 122 and passed through heat exchanger 68 in countercurrent indirect heat exchange with the dense phase natural gas stream in line 66 and gas stream 128. The gas stream in line 128 after passage through heat exchanger 68 is passed through expander 112 for expansion to a lower pressure level than that of expander 110 to provide an indirect heat transfer medium in heat exchanger 70 at a temperature level sufficient to effect direct contact liquefaction of substantially all of the natural gas in flash tank 74 after expansion of the dense phase natural gas in line 66 through valve 72, e.g., in excess of about 90%.

It will be readily appreciated that in accordance with my invention, the conditions of the heating curve of the refrigerant (essentially linear) is essentially matched against the cooling curve of natural gas in the dense phase, i.e., essentially linear. It will be understood that the critical pressure of a natural gas will vary and that the nitrogen content will present problems at high concentrations.

One important aspect of the present invention is the minimization of liquid inventories by use of supplemental storage vessels in the interest of safety. It will be appreciated that by employing a plurality of modules, each having, for example, a capacity of $250 \times 10^6$ SCFD, that reliability is insured as compared to a vessel having a single liquefaction plant.

Numerous modifications and variations of the invention are possible in light of the above teachings and therefore the invention may be practiced otherwise than as particularly described.

What is claimed is:

1. A method of liquefying natural gas having a pressure above the critical pressure thereof, which comprises:

a. expanding said natural gas to a pressure below the critical pressure thereof;

b. introducing the expanded gaseous stream of step (a) into a fractionating zone to remove as a liquid a $C_5$+ hydrocarbon stream;

c. compressing the resulting gas stream recovered from step (b) to a pressure above the critical pressure thereof;

d. cooling the cooled gas stream of step (c);

e. expanding said cooled gas stream from step (d) to effect liquefaction of a major portion of said cooled gas stream of step (d), and f. recovering said liquified major portion.

2. The process as defined in claim 1 wherein the work necessary to compress the gas stream in step (c) is obtained by the energy of expansion of step (a).

3. The process as defined in claim 1 wherein said $C_5$+ hydrocarbon stream includes minor portions of light hydrocarbons and additionally comprising the step of separating such lighter hydrocarbons from $C_5$ and heavier hydrocarbons.

4. The process as defined in claim 3 wherein said lighter hydrocarbons are returned to step (c).

5. The process as defined in claim 1 wherein cooling of said compressed gas is effected by passage in indirect heat transfer relationship with a compressed gaseous refrigerant after the expansion of said compressed gaseous refrigerant.

6. The process as defined in claim 5 wherein the work necessary to compress the gas stream in step (c) is obtained by the energy of expension of step (a).

7. The process as defined in claim 1 wherein liquefied natural gas recovered from step (f) is passed to a storage area.

8. The process as defined in claim 1 wherein said compressed gas is expanded by throttling across a valve to a pressure of about atmospheric pressure.

9. In an apparatus for liquefying natural gas having a pressure above the critical pressure thereof, which comprises:

expander means for reducing the pressure of said natural gas below that of the critical pressure thereof;

separation means for separating a $C_5$+ hydrocarbon stream from said expanded natural gas to obtain a resulting gas stream of $C_4$ or less;

compressor means for compressing the resulting gas stream to a pressure above the critical pressure thereof;

means for cooling said resulting gas stream;

means for expanding said resulting gas stream to effect liquefaction of a major portion thereof; and means for recovering a major portion of said resulting gas stream.

10. The apparatus as defined in claim 9 wherein said compressor means is driven by said expander means.

11. The apparatus as defined in claim 9 wherein said separation means includes fractionator means for separating $C_5$ and heavier hydrocarbons from lighter hydrocarbons.

12. The apparatus as defined in claim 9 wherein said cooling means is comprised of a compressor means, an expander means and heat exchanger means wherein a gaseous refrigerant is compressed, expanded and passed through said heat exchanger means.

13. The apparatus as defined in claim 9 wherein said apparatus is disposed on a vessel and wherein storage means for liquefied natural gas is provided at a location remote from said vessel.

* * * * *